US009732606B2

(12) United States Patent
Frosell

(10) Patent No.: US 9,732,606 B2
(45) Date of Patent: Aug. 15, 2017

(54) SENSOR ACTIVATED DOWNHOLE TOOL LOCATION

(71) Applicant: Halliburton Energy Services Inc., Houston, TX (US)

(72) Inventor: Thomas J. Frosell, Irving, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 126 days.

(21) Appl. No.: 14/389,230

(22) PCT Filed: Dec. 18, 2013

(86) PCT No.: PCT/US2013/075918
§ 371 (c)(1),
(2) Date: Sep. 29, 2014

(87) PCT Pub. No.: WO2015/094204
PCT Pub. Date: Jun. 25, 2015

(65) Prior Publication Data

US 2015/0377009 A1 Dec. 31, 2015

(51) Int. Cl.
*E21B 23/01* (2006.01)
*E21B 47/09* (2012.01)
*E21B 43/04* (2006.01)

(52) U.S. Cl.
CPC ..... *E21B 47/0905* (2013.01); *E21B 23/01* (2013.01); *E21B 43/04* (2013.01); *E21B 47/091* (2013.01)

(58) Field of Classification Search
CPC ..... E21B 47/09; E21B 47/0905; E21B 23/00; E21B 23/01; E21B 23/02; E21B 23/04; E21B 23/06; E21B 23/065
See application file for complete search history.

(56) References Cited

U.S. PATENT DOCUMENTS

| | | | | |
|---|---|---|---|---|
| 3,105,548 | A * | 10/1963 | Ownby | E21B 23/02 166/123 |
| 5,469,736 | A | 11/1995 | Moake | |
| 6,823,938 | B1 | 11/2004 | Milberger | |
| 7,322,416 | B2 | 1/2008 | Burris, II | |
| 2005/0139355 | A1 | 6/2005 | Coronado | |

(Continued)

OTHER PUBLICATIONS

Search Report and Written Opinion of the International Searching Authority;Apr. 16, 2014; 24 pages; U.S. International Searching Authority.

(Continued)

*Primary Examiner* — Robert E Fuller
*Assistant Examiner* — Steven MacDonald

(57) ABSTRACT

A gravel pack tool for interfacing with a gravel pack completion assembly includes a mandrel disposed to fit into a gravel pack completion assembly, the mandrel carrying a sensing mechanism disposed to detect a unique sensing feature positioned at known location within the gravel pack completion assembly. The downhole tool further includes a locating mechanism carried by the mandrel, the locating mechanism disposed to mechanically engage a locating feature within the gravel pack assembly in order to locate the tool relative thereto. The tool includes processing system to activate the locating mechanism in response to detection of a sensing feature by the sensing mechanism.

10 Claims, 8 Drawing Sheets

(56) References Cited

U.S. PATENT DOCUMENTS

| | | | | |
|---|---|---|---|---|
| 2005/0241835 | A1 | 11/2005 | Burris, II | |
| 2008/0236819 | A1 | 10/2008 | Foster | |
| 2009/0139724 | A1* | 6/2009 | Gray | E21B 23/04 166/345 |
| 2012/0234533 | A1* | 9/2012 | Chen | E21B 47/082 166/250.01 |

OTHER PUBLICATIONS

Vickery, E. Harold, et al, New One-Trip Multi-Zone Frac Pack System With Positive Positioning, Oct. 2002, pp. 1-8, Society of Petroleum Engineers Inc., SPE International 78316, Richardson, Texas, USA.

* cited by examiner

SENSOR ACTIVATED DOWNHOLE TOOL LOCATION

CROSS REFERENCE TO RELATED APPLICATIONS

The present application is a U.S. National Stage patent application of International Patent Application No. PCT/US2013/075918, filed on Dec. 18, 2013, the benefit of which is claimed and the disclosure of which is incorporated herein by reference in its entirety.

FIELD OF THE INVENTION

This disclosure relates, in general, to equipment utilized in conjunction with operations performed in subterranean wells and, in particular, locating downhole service tools within a gravel pack completion.

BACKGROUND

Without limiting the scope of the present invention, its background is described with reference to providing communication and sensing during a gravel pack operation within a subterranean wellbore environment, as an example.

In the subterranean well completion and production arts, downhole tools are often lowered into a well completion assembly to perform a variety of tasks. For example, a downhole tool may be lowered into a gravel pack completion assembly to assist in installation of a part of the assembly or as part of other gravel packing operations. Generally, gravel packing operations involve placing a screen into a wellbore. Packers are set above and below the screen and the surrounding annulus is then packed with prepared gravel of a select size designed to inhibit the passage of formation sand. In addition to filtering formation fluids, such a system can help to stabilize the formation without adversely affecting well productivity.

When lowering the downhole tool into the gravel pack completion assembly, the tool must often be positioned at a specific axial location within the completion assembly. This positioning is often referred to as "locating" the downhole tool. To locate a downhole tool at a specific position in a gravel pack completion assembly can be a difficult task because the gravel pack completion assembly can be installed several thousand feet below the surface. When lowering such a downhole tool on a cable, measurement of the length of cable dropped into the wellbore has not been found to be an accurate measurement of the precise position of the downhole tool. Likewise, when lowering such a downhole tool on a tubing or pipe string, traditional locating collets used to land the tool can result in undesirable limits on the outer diameter of other equipment carried by the tubing string. Moreover, the use of J-slots as an alternative to collets introduces uncertainty as to whether the correct J-slot has been engaged and tends to require undesired manipulation of the tubing string through raising, rotating and lowering in order to navigate the J-slots. Accordingly, a need has arisen for an improved apparatus and method for locating downhole tools at a location within a completion.

BRIEF DESCRIPTION OF THE DRAWINGS

For a more complete understanding of the features and advantages of the present disclosure, reference is now made to the detailed description along with the accompanying FIGS. in which corresponding numerals in the different FIGS. refer to corresponding parts and in which.

DESCRIPTION OF ILLUSTRATIVE EMBODIMENTS

Figure 1:
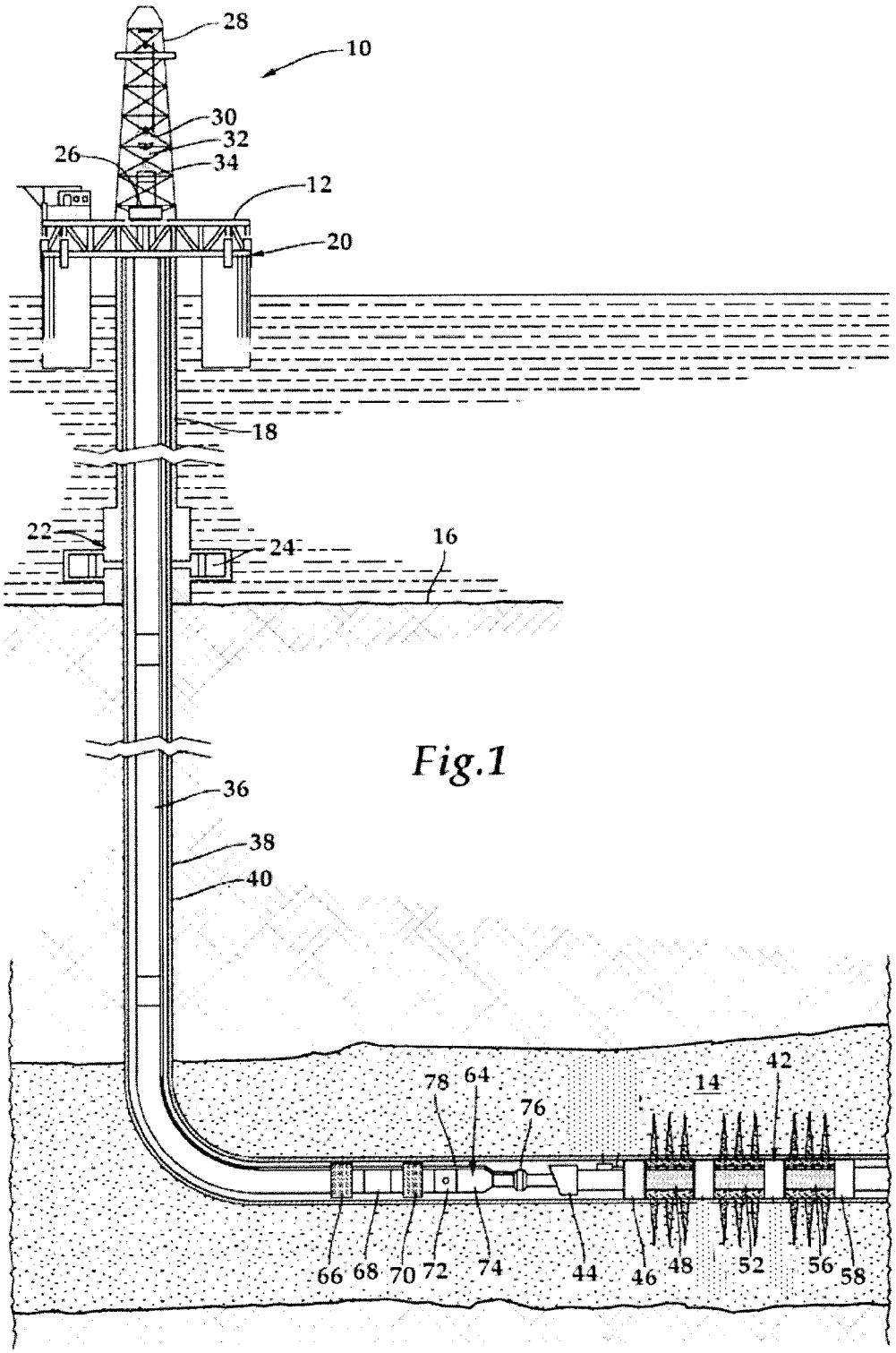
FIG. 1 is a schematic illustration of an offshore oil and gas platform and a completion assembly disposed in a wellbore according to an embodiment of the present disclosure.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the FIGS. The spatially relative terms are intended to encompass different orientations of the apparatus in use or operation in addition to the orientation depicted in the FIGS. For example, if the apparatus in the FIGS. is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Referring initially to FIG. 1, tool assembly 64 is being used to install a lower gravel pack completion assembly 42. Although FIG. 1 is illustrated with respect to an offshore oil or gas platform, unless otherwise specifically stated herein, the disclosure may likewise be used with other types of drilling systems, whether marine or land-based. In any event, as illustrated, a semi-submersible platform 12 is positioned over a submerged oil and gas formation 14 located below the sea floor 16. A subsea conduit 18 extends from a deck 20 of a platform 12 to a subsea wellhead installation 22, which includes blowout preventers 24. The platform 12 has a hoisting apparatus 26, a derrick 28, a travel block 30, a hook 32 and a swivel 34 for raising and lowering pipe strings, such as a substantially tubular, axially extending tubing string 36.

A wellbore 38 extends through the various earth strata including a formation 14 and has a casing string 40 cemented therein. Disposed in a substantially horizontal portion of wellbore 38 is a lower completion assembly 42 that includes various components such as an orientation and alignment subassembly 44, a first packer 46, a first sand control screen assembly 48, a second sand control screen assembly 52, a third sand control screen assembly 56 and a second packer 58.

Disposed in the wellbore 38 at the lower end of the tubing string 36 is tool assembly 64. Tool assembly 64 is generally utilized to install lower completion assembly 42. Although tool assembly 64 need not have any particular components for installing the lower completion assembly, tool assembly 64 may include a first packer 66, an expansion joint 68, a second packer 70, a fluid flow control module 72 and an anchor assembly 74. Also depicted on tubing string 36 is a sensing and locating system 76. Sensing and locating system 76 may be separate from tool assembly 64 or integrated as part of tool assembly 64.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Also, even though FIG. 1 depicts a cased hole completion, it should be understood by those skilled in the art that the apparatus according to the present disclosure is equally well suited for use in open hole completions.

Figure 2A:
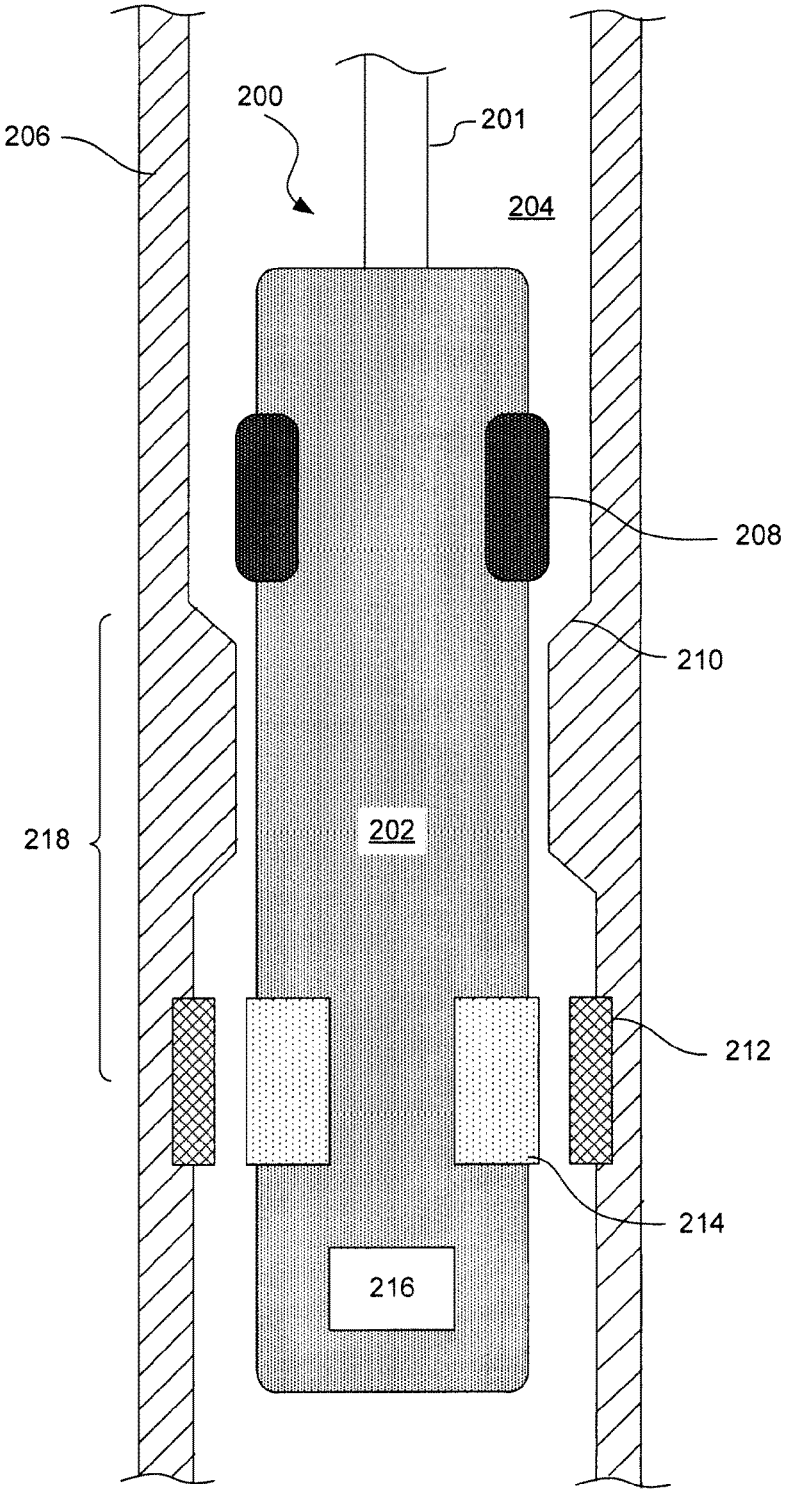
FIG. 2A is a schematic illustration of a downhole tool within a gravel pack completion according to an embodiment of the present disclosure.

FIG. 2A is a schematic illustration of a downhole tool 200 within a tubular section 206 of lower completion assembly 42. According to embodiments, the downhole tool 200 is carried on a tubing string 201. Downhole tool 200 includes a mandrel or body 202. Attached to the mandrel or body 202 is a locating mechanism 208, a sensing mechanism 214, and a control or processing system 216. Lower completion assembly 42 includes a locating feature 210, and a sensing feature 212. In some preferred embodiments, locating feature 210 and sensing feature 212 are carried by or otherwise included as part of tubular section 206. While downhole tool 200 is described as being carried by a tubing string 201, in other embodiments, downhole tool 200 may be carried by a wireline, slickline or other type of cable.

The locating mechanism 208 is used to locate the downhole tool 200 on the locating feature 210. Various types of locating mechanisms 208 may be used with corresponding locating features. In some embodiments, the locating feature 210 is a shoulder, landing ring, collar or similar restriction formed within the tubular section 206. In other embodiments, the locating feature 210 is a shoulder, recess or similar featured formed along the interior surface of tubular section 206. The tubular section 206 may typically include several similar locating features placed axially along the length of lower completion assembly 42.

In some embodiments, the locating mechanism 208 may be fingers, dogs or other radially extendable members that can be set in either a collapsed position or an extended position. In other embodiments, the locating mechanism 208 may be an expandable or inflatable bladder. When the locating mechanism 208 is in the collapsed or retracted configuration, the downhole tool 200 is able to move past restrictions in tubular sections through which it traverses until reaching the general vicinity of a desired locating feature 210 to which the downhole tool 200 is ultimately to be engaged. While the locating mechanism 208 is in the extended or expanded position, it will interface with the locating feature 210 and restrict further movement of the downhole tool 200.

As described above, because the downhole tool 200 is often working at depths of several thousand feet below the surface, it can be difficult to determine the exact location of the downhole tool 200 within the lower completion assembly 42, and in particular, tubular section 206. Moreover, it is important that the downhole tool 200 locate on a desired locating feature 210 rather than an adjacent locating feature. Through use of methods and systems embodying principles described herein, the sensing mechanism 214 is used to determine when to activate the locating mechanism 208, thereby driving or otherwise urging the locating mechanism 208 from a first collapsed or retracted position to a second expanded or extended position.

Accordingly, embodiments of the downhole tool 200 include a sensing mechanism 214 attached to the body 202. In some embodiments, the distance between the sensing mechanism 214 and the locating mechanism 208 corresponds to the distance 218 between the sensing feature 212 and the locating feature 210. In other embodiments, the distance between the between the sensing mechanism 214 and the locating mechanism 208 is greater than the distance 218 between the sensing feature 212 and the locating feature 210. Thus, as the downhole tool 200 moves through tubular section 206, the sensing mechanism 214 will pass the sensing feature 212 of the completion. The sensing feature 212 can be unique and thus the sensing mechanism 214 can be programmed to look for a particular sensing feature 212. In some embodiments, the sensing feature 212 may have a unique physical shape or dimension. Alternatively, the sensing feature, if electrical, may have a unique identification address or operating frequency. As used herein, "unique" may also simply mean a particular sensing feature in a string of numerically ordered sensing features, such as, for example, the third sensing feature in a string of six sensing features.

When the sensing mechanism 214 passes the sensing feature 212, a signal can be provided to the processing system 216. The processing system 216 can then send a signal to the locating mechanism 208 that will cause the locating mechanism 208 to configure from the first position to the second position and thereby engage locating feature 210. This will then cause the downhole tool 200 to locate at the precise desired location with respect to lower completion assembly 42.

Figure 2B:
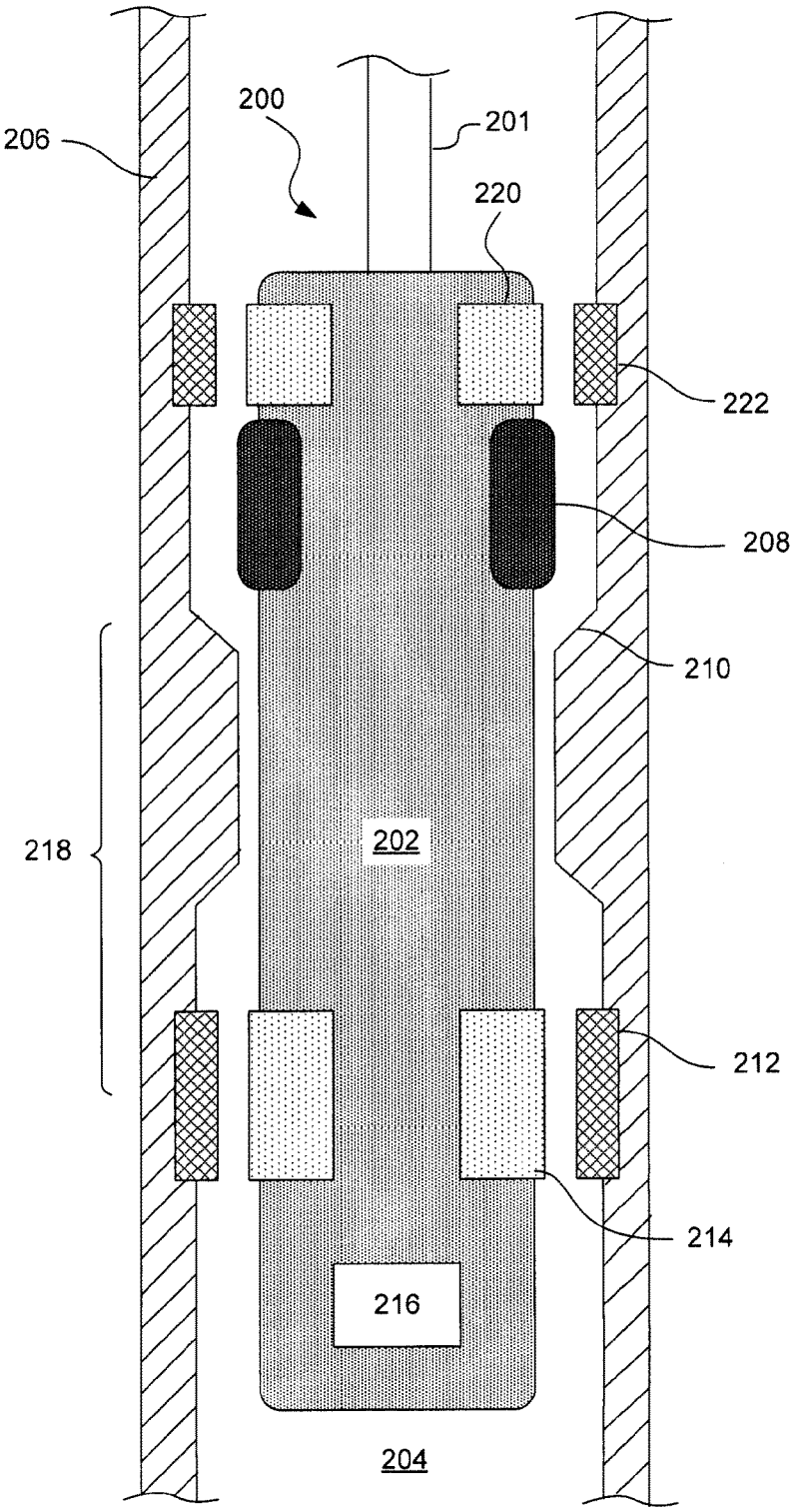
FIG. 2B is a schematic illustration of a downhole tool having additional sensing mechanisms according to an embodiment of the disclosure.

FIG. 2B is a schematic illustrative of a downhole tool 200 having an additional sensing mechanism 220. According to some embodiments, the additional sensing mechanism 220 also corresponds to an additional unique sensing feature 222. Use of additional sensing mechanisms 220 and sensing features 222 can further validate the placement of the downhole tool 200 with respect to lower completion assembly 42.

In one embodiment, the additional sensing mechanism 220 may be positioned so that locating mechanism 208 is between sensing mechanism 220 and sensing mechanism 214. This allows a sensing feature 212, 222 to trigger activation of the locating mechanism 208 during both upward and downward movement. In some embodiments, the additional sensing mechanism 220 may be a different type of sensing mechanism than sensing mechanism 214. A variety of different types of sensing mechanisms 214, 220, may be used with corresponding sensing features 212, 222.

In some embodiments, second sensing mechanism 220 may be positioned adjacent to first sensing mechanism 214, such as downhole from first sensing mechanism 214. In this configuration, second sensing mechanism 220, upon encounter a sensing feature, can be utilized to alter the descent rate of tool 200 by slowing the descent. Then, first sensing mechanism 214, upon encountering a sensing feature, can be used to activate the locating mechanism 208 as described herein. Persons of skill in the art will appreciate that the same or different locating features may be utilized for such operation.

Moreover, while sensing mechanism 214 is described as carried by completion tool 200 and sensing feature 212 is described as positioned on or about lower completion assembly 42, persons of skill in the art will understand, and it is contemplated herein, that the relative positions of sensing mechanism 214 and sensing feature 212 may be reversed. As such, in certain embodiments, sensing mechanism 214 may be positioned on or about lower completion assembly 42 (such as carried by tubular section 206) and sensing feature 212 may be carried on completion tool 200.

Figure 3A:
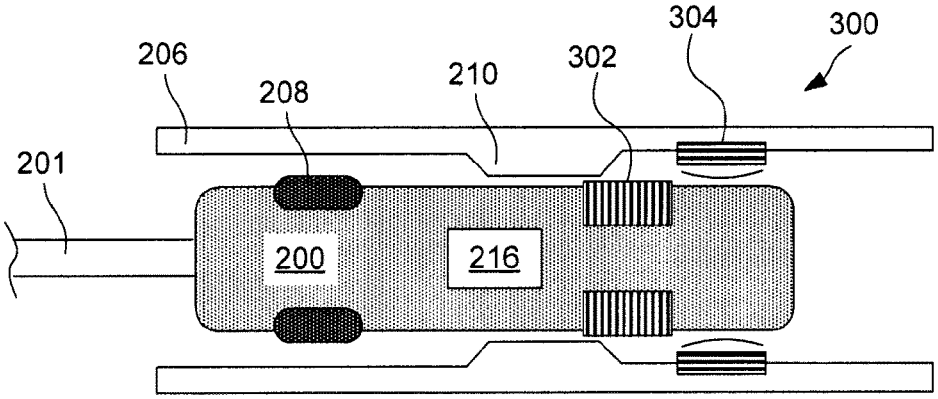
FIGS. 3A-3C are schematic diagrams illustrating various types of sensors to be used with a downhole tool according to an embodiment of the present disclosure.
Figure 3B:
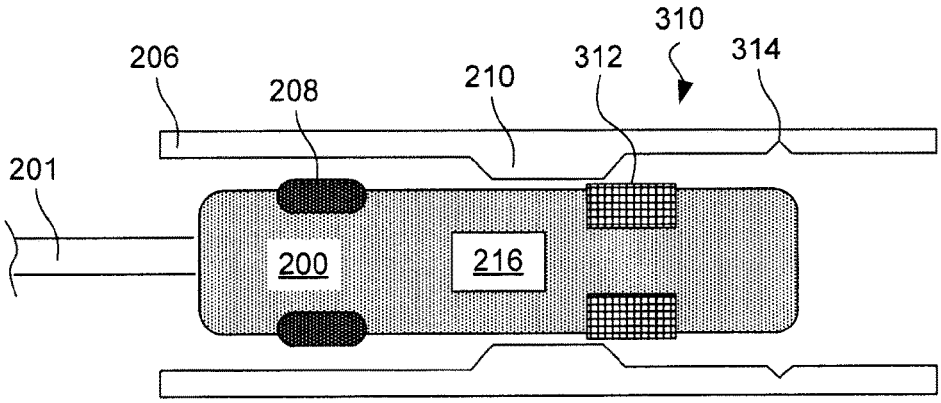
Figure 3C:
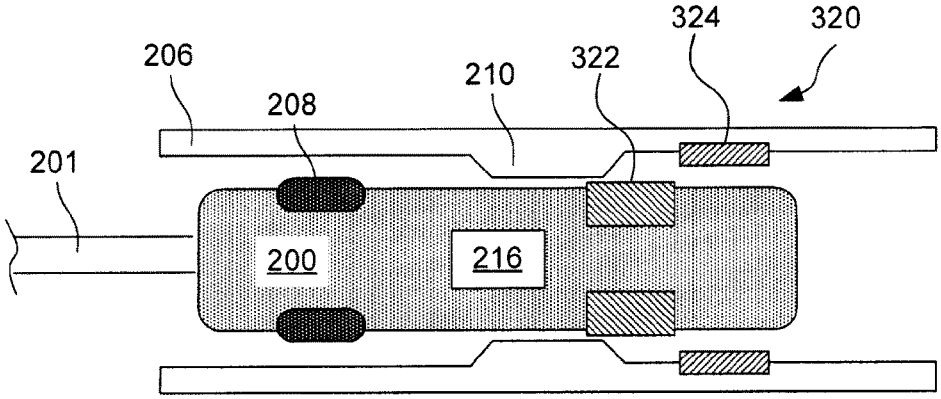

FIGS. 3A-3C are schematic diagrams illustrating various types of sensing mechanisms to be used with a downhole tool 200. FIG. 3A is a schematic diagram illustrating a magnetic sensing system 300. According to some embodiments, the sensing feature (212, FIG. 2) is a magnet 304 specifically positioned relative to lower completion assembly 42. In particular, magnet 304 may be placed within the tubular section 206, and sensing mechanism (214, FIG. 2) is a magnetic reader 302.

One or more magnets 304 placed at a specific location within the completion 206. The magnet or magnets 304 may be made of a permanent magnetic material. The magnet or magnets 304 may have a unique magnetic signature that differentiates themselves from other similar sensing features within the completion 206. In some embodiments, a plurality of magnets may be positioned and oriented in such a way so as to create a unique magnetic signature that is readable by the magnetic reader 302. Alternatively or in addition thereto, for both this and the other embodiments described herein, processing system 216 may be configured to count or record the number of sensing features 212 encountered by sensing mechanism 214. In this way, rather than associating a unique physical feature or electrical signal with a sensing feature 212, processing system 216 can track the number of sensing features 212 encountered and activate locating mechanism 208 when a predetermined number of sensing features 212 have been encountered.

In any event, magnetic reader 302 may include one or more magnetic reading components placed around the circumference of the downhole tool 200. The magnetic reader 302 may be designed to measure the magnetic signatures of magnets 304 disposed within lower completion assembly 42. The magnetic reader 302 can be programmed to identify a magnet having a specific magnetic signature. When such a magnet 304 is identified, the magnetic reader 302 sends a signal to the processing system 216 that will activate the locating mechanism 208.

FIG. 3B is a schematic diagram showing an illustrative ultrasonic sensing system 310. According to some embodiments, the sensing mechanism (214, FIG. 2) may be an ultrasonic instrument 312. Additionally, the sensing feature (212, FIG. 2) may be a unique profile 314 within the tubular section 206.

The ultrasonic instrument 312 uses sonic waves to measure the inner profile of the completion 206 as the downhole tool 200 moves through the completion 206. The ultrasonic instrument 312 can be programmed to monitor for a specific physical profile, such as a specific change or shape disposed along the inner diameter of tubular section 206. This profile represents the unique profile 314 used as the sensing feature. When the unique profile 314 is identified, the ultrasonic instrument 312 sends a signal to the processing system 216. The processing system 216 can then send a signal to the locating mechanism 208, causing the locating mechanism 208 to engage the locating feature 210.

FIG. 3C is a schematic diagram showing an illustrative Radio Frequency Identification (RFID) sensing system 320. According to one embodiment, the sensing mechanism (214, FIG. 2) may be an RFID reader 322. Additionally, the sensing feature (212, FIG. 2) may be an RFID tag or chip 324. The system 320 can be an active or passive RFID system.

In some embodiments, the RFID reader 322 emits an electromagnetic field. When that electromagnetic field passes an RFID chip 324, RFID reader 322 emits sufficient power to cause the RFID chip 324 to transmit a signal. The RFID reader 322 detects the signal and provides the received information to a control device.

In the illustrated embodiment, as the downhole tool 200 passes the RFID chip 324, the RFID reader 322 emits an electromagnetic field that activates the RFID chip 324. This activation may include providing power to RFID chip 324 or simply waking RFID chip 324 from a dormant state. The RFID chip 324 then transmits a signal representing a unique code associated with the particular RFID chip 324. The RFID reader 322 detects the signal, and if the unique code matches a desired code, the RFID reader 322 can send a signal to the processing system 216. The processing system 216 will then activate locating mechanism 208, causing the locating mechanism 208 to engaged locating feature 210.

The sensing systems 300, 310, 320 described in FIGS. 3A-3C, respectively, are merely exemplary embodiments of different sensing systems that can be used in association with a completion tool in accordance with a system or method embodying principles described herein. Other sensing systems are contemplated. Additionally, different types of locating mechanisms 208 may be used as well for locating a completion tool within a lower completion assembly.

Figure 4A:
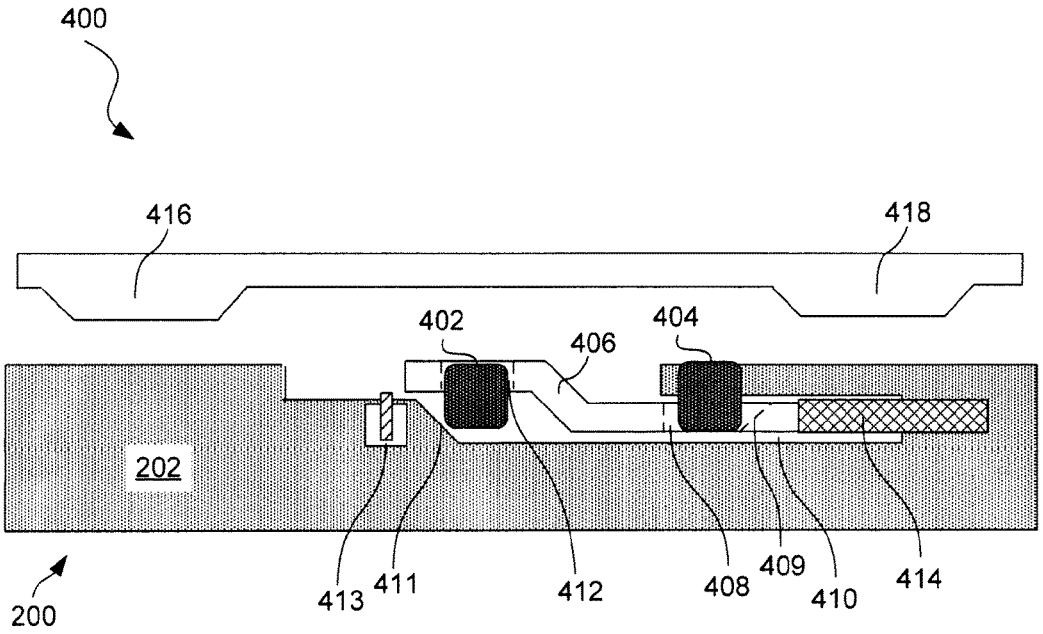
FIGS. 4A and 4B are schematic diagrams illustrating operation of a spring-loaded locating mechanism of a downhole tool according to an embodiment of the present disclosure.
Figure 4B:
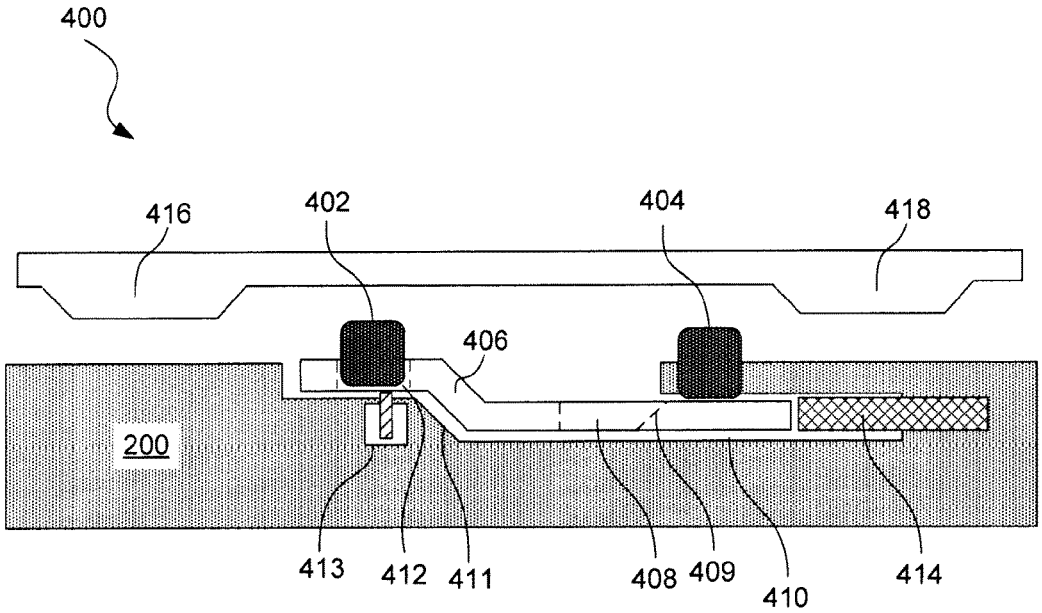

FIGS. 4A and 4B are schematic diagrams illustrating embodiments of a locating mechanism (208 FIG. 1), and in particular, operation of a spring-loaded locating mechanism of a downhole tool. FIG. 4B is a schematic diagram illustrating a locating mechanism 400 in the expanded position. FIG. 4A is a schematic diagram illustrating the locating mechanism 400 in the retracted position as it would be when tool 200 is run in to a wellbore (not shown).

According to some embodiments, the locating mechanism 400 includes a locating dog 404 and a reset dog 402, each of which is generally urged inward by known means, such as for example, by springs or pressurized fluid. Locating dog 404 is carried by mandrel 202 of tool 200 and is disposed to move radially relative to the primary longitudinal axis of tool 400. The reset dog 402 is carried in a slot 412 formed in dog support structure 406. The dog support structure 406 also includes a slot 408 disposed for receipt of the locating dog 404 carried by tool 200 when slot 408 is aligned with locating dog 404. Slot 408 may include an inclined portion, as shown at 409. The dog support structure 406 slides axially within a recess 410 formed in tool 200 with a shoulder 411 disposed along the recess. The dog support structure 406 is connected to a spring mechanism 414.

As shown in FIG. 4A, in a first retracted position, i.e., when tool 200 is run in to a wellbore, pin 413 is extended to secure support structure 406 within recess 410. Moreover, dog support structure 406 is positioned in recess 410 so that support structure 406 is spaced apart from shoulder 411, thereby permitting reset dog 402 to be maintained in a radially retracted position, urged inward in slot 412 by a spring (not shown) or similar mechanism. Additionally, locating dog 404 is aligned with slot 408 of support structure 406 and is urged into the slot 408 by a spring (not shown) or similar mechanism, such that locating dog 404 is in a radially retracted position relative to mandrel 202. In this position, support structure 406 compresses against spring mechanism 414, being secured by pin 413.

As shown in FIG. 4B, in a second expanded position, i.e., when tool 200 is landed, both the reset dog 402 and the locating dog 404 extend radially outward. Specifically pin 413 is retracted, allowing spring mechanism 414 to urge dog support structure 406 to the left as illustrated. In this position, dog 402 is urged radially outward by shoulder 411 as support structure 406 abuts shoulder 411. Likewise, in transitioning to this position, dog 404 rides up the inclined portion 409 of slot 408 and support structure 406 slides under dog 404 to maintain dog 404 in an axially extended position. With the dogs 402, 404 extended, the downhole tool 200 can locate on the locating feature 418. Thus, as the downhole tool 200 moves to the right, the locating dog 404 will engage the locating feature 418.

To drive locating mechanism 400 back to a retracted position, the downhole tool 200 is moved so that reset dog 402 abuts reset feature 416. Further movement of tool 200 in this direction pushes reset dog 402 in the opposite direction, which in turn urges dog support structure 406 to compress spring mechanism 414 until pin 413 extends to secure mechanism 400 in this position.

Thus, while in the retracted position, pin mechanism 413, such as an electrically or hydraulically activated pin, can be used to secure the dog support structure 406 in place with the spring mechanism 414 compressed, such as for run-in. The locating mechanism 400 may be retained in this position until the pin mechanism 413 is released, thereby releasing the spring mechanism 414 to urge the dog support structure 406 back into the expanded position. Release of the pin mechanism 413 may occur, for example, in response to the sensor mechanism (214, FIG. 2) sensing the specific sensing feature (212, FIG. 2). Although spring mechanism 414 has been described as the apparatus for urging dog support structure 406 along slot 410, persons of skill in the art will appreciate that other mechanism, such as electrically activated screws or rods or hydraulically activated pistons or the like may be used. In some embodiments, collets could be used instead of the dogs.

Figure 5A:
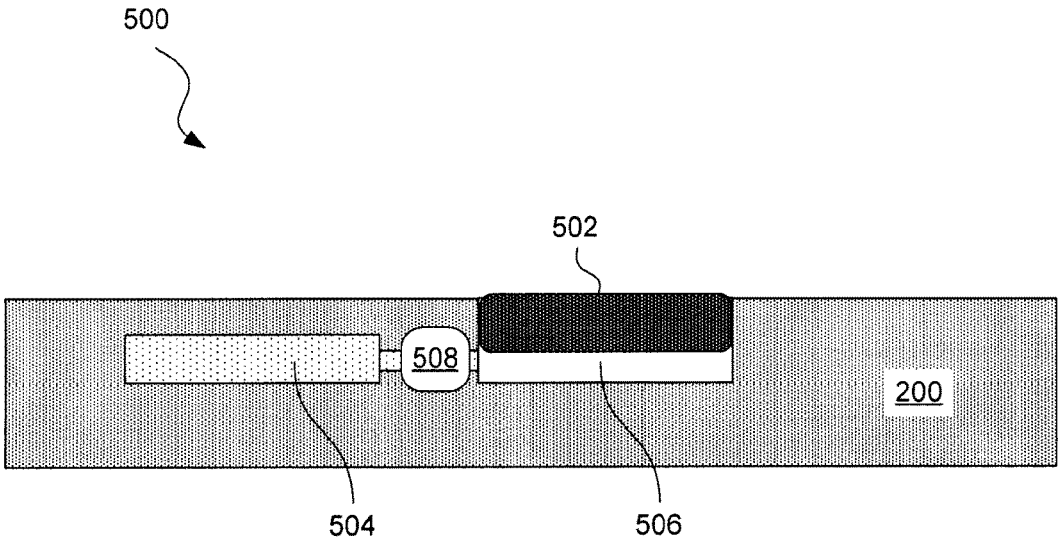
FIGS. 5A and 5B are schematic diagrams illustrating operation of a hydraulic locating mechanism of a downhole tool according to an embodiment of the present disclosure.
Figure 5B:
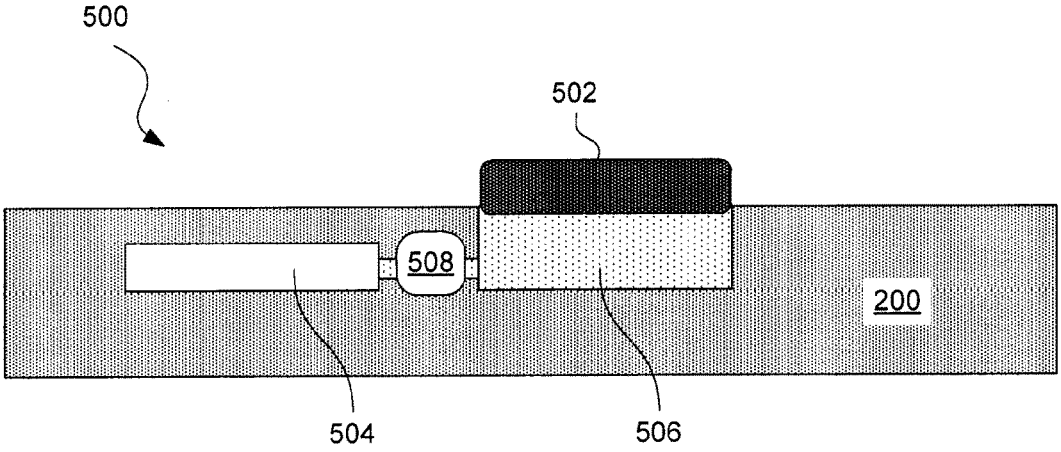

FIGS. 5A and 5B are schematic diagrams illustrating operation of a hydraulic locating mechanism 500 of a downhole tool 200. FIG. 5A illustrates the hydraulic locating mechanism 500 in the retracted position. FIG. 5B illustrates the hydraulic locating mechanism 500 in the extended position. According to some embodiments, the hydraulic locating mechanism 500 includes a locating dog 502, a hydraulic piston mechanism 506, a hydraulic reservoir 504, and a hydraulic pump 508.

While in the collapsed position, the hydraulic locating dog 502 is maintained in a retracted position within the hydraulic piston mechanism 506. The hydraulic piston mechanism 506 is in fluid connection with the reservoir 504. The hydraulic pump 508 is in fluid connection with, and set to pump hydraulic fluid between, the reservoir 504 and piston mechanism 506.

To drive the locating mechanism 500 to the extended position, the hydraulic pump 508 pumps the hydraulic fluid from the reservoir 504 into the piston mechanism 506, thereby urging hydraulic locating dog 502 outward as illustrated. The hydraulic dog 502 can then interface with a locating feature to locate the downhole tool 200 at the desired location.

Figure 6:
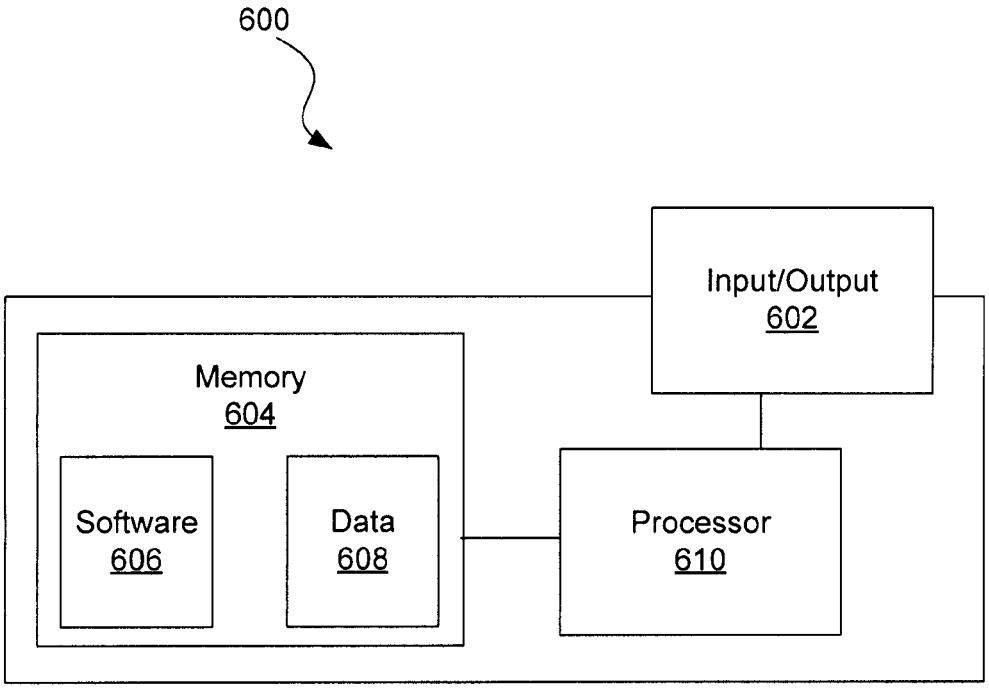
FIG. 6 is a block diagram showing an illustrative processing system that can be used in accordance with a downhole tool according to an embodiment of the present disclosure.

FIG. 6 is a block diagram showing an illustrative control or processing system 600 that can be used in accordance with a downhole tool (200. FIG. 2). According to some embodiments, the processing system 600 includes a memory 604 that includes software 606 and a data store 608. The processing system 600 also includes a processor 610 and an Input/Output (I/O) port 602.

The memory 604 may be one of several different types of memory. Some types of memory, such as solid state drives, are designed for storage. These types of memory typically have large storage volume but relatively slow performance. Other types of memory, such as those used for Random Access Memory (RAM), are optimized for speed and are often referred to as "working memory." The various types of memory may store information in the form of software 606 and data 608.

The processing system 600 also includes a processor 610 for executing the software 606 and using or updating the data 608 stored in memory 604. The software 606 may include instructions for receiving and processing signals from the sensing mechanism (214, FIG. 2). The software 606 may further include instructions for sending control signals to the locating mechanism (208, FIG. 2) in response to signals received from the sensing mechanism.

In embodiments where the sensing mechanism is an ultrasonic instrument, the data 608 may include information such as a set of unique profile signatures corresponding to locations within the completion. In embodiments where the sensing features are magnets, the data 608 may include a set of unique magnetic signatures corresponding to locations within the completion. In embodiments where the sensing features are RFID tags or chips, the data 608 may include a set of unique RFID addresses corresponding to their locations within the completion. Thus, when the processing system 600 receives a signal from the sensing mechanism through the I/O port 602, it can compare the signal with the signatures or profiles stored in the data and determine whether the downhole tool is in the proper location. If the downhole tool (200, FIG. 2) is indeed in the proper location, the processing system 600 will send a signal through the I/O port 602 to the locating mechanism, thereby causing the locating mechanism to locate the downhole tool.

Figure 7:
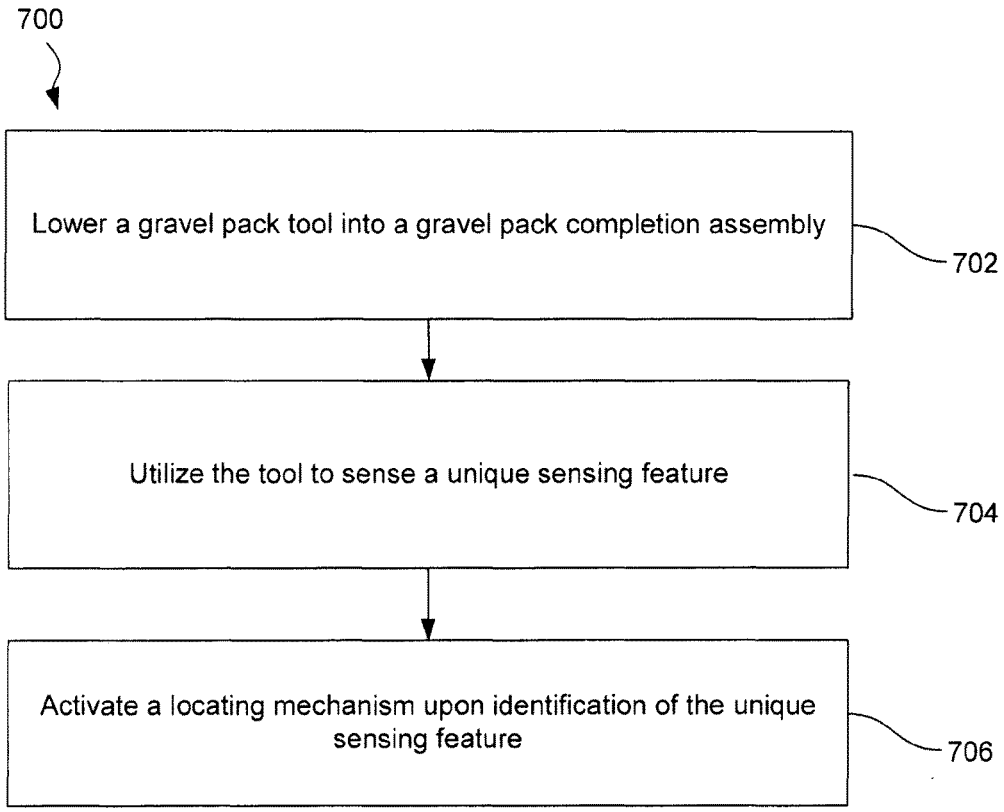
FIG. 7 is a flowchart showing an illustrative method for locating a downhole tool within a gravel pack completion according to an embodiment of the present disclosure.

FIG. 7 is a flowchart showing an illustrative method for locating a downhole tool within a gravel pack completion. According to some embodiments, the method 700 includes a step 702 for lowering a body of the downhole tool within a gravel pack completion assembly. The downhole tool may be one of a variety of downhole tools used for gravel pack operations. The downhole tool includes features embodying principles described herein.

The method 700 further includes a step 704 for lowering the downhole tool past a unique sensing feature. Specifically, the sensing mechanism, which is fixedly secured to the body of the downhole tool, passes a unique sensing feature within the completion. The sensing feature has been placed at a predetermined location within the completion. The sensing mechanism is disposed to sense the sensing feature as the sensing feature is adjacent the sensing mechanism and send a signal to a control unit.

The method 700 further includes a step 706 for activating the locating mechanism. Specifically, based on the signal sent to the control unit in response to passing the sensing feature, the locating mechanism attached to the body is activated. Activating the locating mechanism mechanically locates the body of the downhole tool on a locating feature within the gravel pack completion assembly. The location occurs at a distance from the sensing feature that corresponds to a distance between the locating mechanism and the sensing mechanism.

Accordingly, through use of methods, systems, and apparatuses described herein, a downhole tool can locate at a precise location on a locating feature that is not unique to that location. For example, the locating tool can pass multiple locating features, each locating feature corresponding to a unique sensing feature. When the downhole tool passes a specific sensing feature, the downhole tool then locates on the corresponding locating feature. This allows for accurate and efficient operation during deployment of the gravel pack system.

Thus, gravel pack system for locating a gravel pack tool within a gravel pack assembly has been described. Embodiments of the gravel pack system may generally have a gravel pack assembly comprising a first unique sensing feature and a locating feature; a gravel pack tool comprising a mandrel disposed for receipt by the gravel pack assembly; a first sensing mechanism carried by the mandrel, the first sensing mechanism to detect the first unique sensing feature within the gravel pack assembly; a locating mechanism attached to the mandrel, the locating mechanism to mechanically locate the mandrel on the locating feature, wherein, a distance between the locating mechanism and the first sensing mechanism corresponds to a distance between the locating feature and the first sensing feature; and a processing system to cause the locating mechanism to locate on the locating feature in response to the first sensing mechanism detecting the first sensing feature.

Likewise, a downhole service tool for insertion into a gravel pack completion has been described. Embodiments of the tool may generally have a body to fit into a gravel pack completion; a sensing mechanism attached to the body, the sensing mechanism to detect a unique sensing feature within the completion, the sensing feature placed at a predetermined location within the completion; a locating dog attached to the body, the locating dog to mechanically locate the body on a locating feature within the gravel pack completion, wherein, a distance between the locating dog and the sensing mechanism corresponds to a distance between the locating feature and the sensing feature; a processing system to cause the locating dog to move from a spring loaded position into an expanded position to locate on the locating feature in response to the sensing mechanism detecting the sensing feature; and a reset dog to push the locating dog form the expanded position to the spring loaded position when the body is moved through a reset feature. For any of the foregoing embodiments, any one of the following elements, alone or in combination with each other may be included:

A first sensing mechanism comprises a magnetic sensor and the first unique sensing feature comprises a magnet.

A first unique sensing feature comprises a plurality of magnets oriented to create a unique magnetic signature.

A first sensing mechanism comprises an ultrasonic instrument and the first sensing feature comprises a predetermined physical profile.

A first sensing mechanism comprises a Radio Frequency Identification (RFID) reader and a first sensing feature comprises an RFID transmitter.

A second sensing mechanism carried by the mandrel to detect a second sensing feature within the gravel pack assembly.

A locating mechanism is positioned between a second sensing mechanism and a first sensing mechanism along the mandrel.

A second sensing mechanism is a different type of sensing mechanism than a first sensing mechanism.

A plurality of the same locating feature disposed axially along the gravel pack assembly.

A locating feature comprises a radially extendable locating dog carried by the mandrel and movable between an extended position and a retracted position; an elongated dog support structure slidingly engaged with the mandrel and disposed to axially slide relative to the mandrel; and a radially extendable reset dog carried by the dog support structure and movable between an extended position and a retracted position.

A locating feature comprises a locating dog that is extendable by a piston mechanism.

A sensing mechanism comprises one of: a magnetic sensor, an ultrasonic instrument, and a Radio Frequency Identification (RFID) reader, and the sensing feature corresponds to the sensing mechanism.

At least one additional sensing mechanism secured to the body, the at least one additional sensing mechanism to detect at least one additional sensing feature within the completion.

Thus, a method for operating a downhole tool within a gravel pack completion has been described. Embodiments of the method may generally include lowering a gravel pack tool within a gravel pack completion assembly; utilizing a sensing mechanism carried by the tool to identify a unique sensing feature disposed within the completion assembly, the sensing feature placed at a predetermined location within the completion assembly; and upon identification of the unique sensing feature, activating a locating mechanism carried by the tool to mechanically locate the tool on a locating feature within the gravel pack completion assembly. For any of the foregoing embodiments, the system may include any one of the following elements, alone or in combination with each other:

A locating mechanism comprises a plurality of collets.

A sensing mechanism and a sensing feature respectively comprise one of: an ultrasonic instrument and a predetermined physical profile; and a magnetic sensor and a plurality of magnets oriented to create a unique magnetic signature.

A sensing mechanism comprises a Radio Frequency Identification (RFID) reader and a sensing feature comprises an RFID transmitter.

Sliding a support relative to the tool until a locating dog is forced radially outward by the support to an extended position.

Deactivating a locating mechanism by utilizing a reset dog to sliding a support relative to a tool until the locating dog retracts from the extended position.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A gravel pack system for locating a gravel pack tool within a gravel pack assembly, the system comprising:

a gravel pack assembly comprising a first differentiable sensing feature and a locating feature;

a gravel pack tool comprising a mandrel disposed for receipt by the gravel pack assembly;

a first sensing mechanism carried by the mandrel, the first sensing mechanism to detect the first differentiable sensing feature within the gravel pack assembly;

a second sensing mechanism carried by the mandrel to detect a second sensing feature within the gravel pack assembly;

a locating mechanism attached to the mandrel longitudinally between the second sensing mechanism and the first sensing mechanism along the mandrel, the locating mechanism to mechanically locate the mandrel on the locating feature, wherein, a distance between the locating mechanism and the first sensing mechanism corresponds to a distance between the locating feature and the first sensing feature; and a processing system to cause the locating mechanism to locate on the locating feature in response to the first sensing mechanism detecting the first sensing feature.

2. The gravel pack system of claim 1, wherein the first sensing mechanism comprises a magnetic sensor and the first differentiable sensing feature comprises a magnet.

3. The gravel pack system of claim 2, wherein the first differentiable sensing feature comprises a plurality of magnets oriented to create a differentiable magnetic signature.

4. The gravel pack system claim 1, wherein the first sensing mechanism comprises an ultrasonic instrument and the first sensing feature comprises a predetermined physical profile.

5. The gravel pack system of claim 1, wherein the first sensing mechanism comprises a Radio Frequency Identification (RFID) reader and the first sensing feature comprises an RFID transmitter.

6. The gravel pack system of claim 1, wherein the second sensing mechanism is a different type of sensing mechanism than the first sensing mechanism.

7. The gravel pack system of claim 1, further comprising a plurality of the same locating feature disposed axially along the gravel pack assembly.

8. The gravel pack system of claim 1, wherein the locating feature comprises:

a radially extendable locating dog carried by the mandrel and movable between an extended position and a retracted position;

an elongated dog support structure slidingly engaged with the mandrel and disposed to axially slide relative to the mandrel; and a radially extendable reset dog carried by the dog support structure and movable between an extended position and a retracted position.

9. The gravel pack system of claim 1, wherein the locating mechanism comprises a locating dog that is extendable by a piston mechanism.

10. The gravel pack system of claim 1, wherein the locating feature is disposed longitudinally between the first differentiable sensing feature and the second sensing feature.

* * * * *